US006291787B1

(12) United States Patent
Wuerth et al.

(10) Patent No.: US 6,291,787 B1
(45) Date of Patent: Sep. 18, 2001

(54) CONTACT PROTECTION HOUSING FOR AN ELECTRICAL CONNECTION

(75) Inventors: Walter Wuerth, Bietigheim-Bissingen; Gerhard Liebing, Stuttgart; Hans Staudenmaier, Waiblingen; Markus Nieslony, Salach, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/355,666

(22) PCT Filed: Jan. 26, 1998

(86) PCT No.: PCT/DE98/00227

§ 371 Date: Feb. 15, 2000

§ 102(e) Date: Feb. 15, 2000

(87) PCT Pub. No.: WO98/34303

PCT Pub. Date: Aug. 6, 1998

(30) Foreign Application Priority Data

Jan. 31, 1997 (DE) ..... 197 03 686

(51) Int. Cl.[7] ..... H01H 33/02

(52) U.S. Cl. ..... 218/155; 335/202

(58) Field of Search ..... 218/149, 150, 218/155, 156, 157, 15; 200/293–308; 335/202

(56) References Cited

U.S. PATENT DOCUMENTS 3,555,215 * 1/1971 Dehn ..... 200/166
5,184,102 * 2/1993 Mueller ..... 335/202

FOREIGN PATENT DOCUMENTS 30 14 333 10/1981 (DE) .
2 204 194 11/1988 (GB) .

* cited by examiner

*Primary Examiner*—Lincoln Donovan
(74) *Attorney, Agent, or Firm*—Kenyon & Kenyon

(57) ABSTRACT

In an arc suppression housing for an electric connection the contacts are located in at least one housing part filled with sealing compound. The arc suppression housing is composed of at least two separate housing parts put together to form a preferably enclosed shape, at least one of which housing parts having a sealing compound filling channel formed by material removal.

5 Claims, 2 Drawing Sheets

CONTACT PROTECTION HOUSING FOR AN ELECTRICAL CONNECTION

FIELD OF THE INVENTION

The present invention relates to an arc suppression housing for an electric connection with the contacts located in at least one housing filled with a sealing compound.

BACKGROUND INFORMATION

It is known that sealing compounds can be used for sealing electric plug-and-socket connections, soldered connections or the like. Reactive single- or two-component adhesives and/or sealants that set at room temperature or at higher temperatures are used as sealing compounds. They are processed mostly at atmospheric pressure.

An arc suppression housing has a comb-like design with the contact zone located within the chamber designed as a trough, in particular. Contact tabs are connected here with stranded conductors, for example, in particular by soldering or welding. When the electric contact is established, liquid sealing compound is filled into the chamber from above, distributed by gravity and hardened. The disadvantage here is that, depending on the contour of the chamber possibly defined by certain parameters and on the contact zone design, undercuts and cavities may be created, into which the sealing compound does not penetrate completely as it sets, so that air inclusions that negatively affect the protective function of the compound are formed.

SUMMARY OF THE INVENTION

Being composed of at least two separate housing parts put together to form an enclosed shape, the arc suppression housing according to the present invention ensures that the arc suppression area is preferably completely enclosed with at least one of the housing parts having a sealing compound filling channel formed by material removal. It is preferably designed so that during filling the sealing compound goes into the desired area or areas inside the arc suppression housing, and/or the sealing compound can be filled in at a pressure that is higher than atmospheric pressure due to the enclosed arc suppression housing. This always guarantees that no undesired bubbles are formed.

The sealing compound filling channel formed in the arc suppression housing preferably opens at the outside of the housing into a spray tool sealing funnel, which serves for coupling a spray tool for delivering the sealing compound.

The spray tool and the sealing funnel form, during casting, a hermetic and secure connection, which ensures that the liquid sealing compound being filled into the arc suppression housing cannot leak out at the contact point between the spray tool and the sealing funnel. This simple contact between the spray tool and the arc suppression housing to be filled makes the latter particularly suitable for assembly-line production.

The spray tool sealing funnel is preferably designed so that it extends beyond one side of the arc suppression housing, and is in particular attached to it via a break-off point.

The advantage of this is that after casting and setting of the sealing compound, the sealing funnel can be removed in a simple manner. This may shorten the manufacturing time in mass production, for example.

Because the arc suppression housing is made of at least two housing parts put together, a leakproof fit is important, in particular when the sealing compound is delivered under pressure. For this purpose, one of the housing parts has a circumferential groove, into which a gasket is placed to ensure the tightness with respect to the mating contour when the two housing parts are put together. The gasket thus installed, however, does not only prevent the liquid, i.e., not yet set, sealing compound from leaking out, but it also has the property of being gas-permeable, which accelerates the exit of the air entrained by the sealing compound, so that the assurance of bubble-free casting is enhanced.

DETAILED DESCRIPTION

Figure 1:
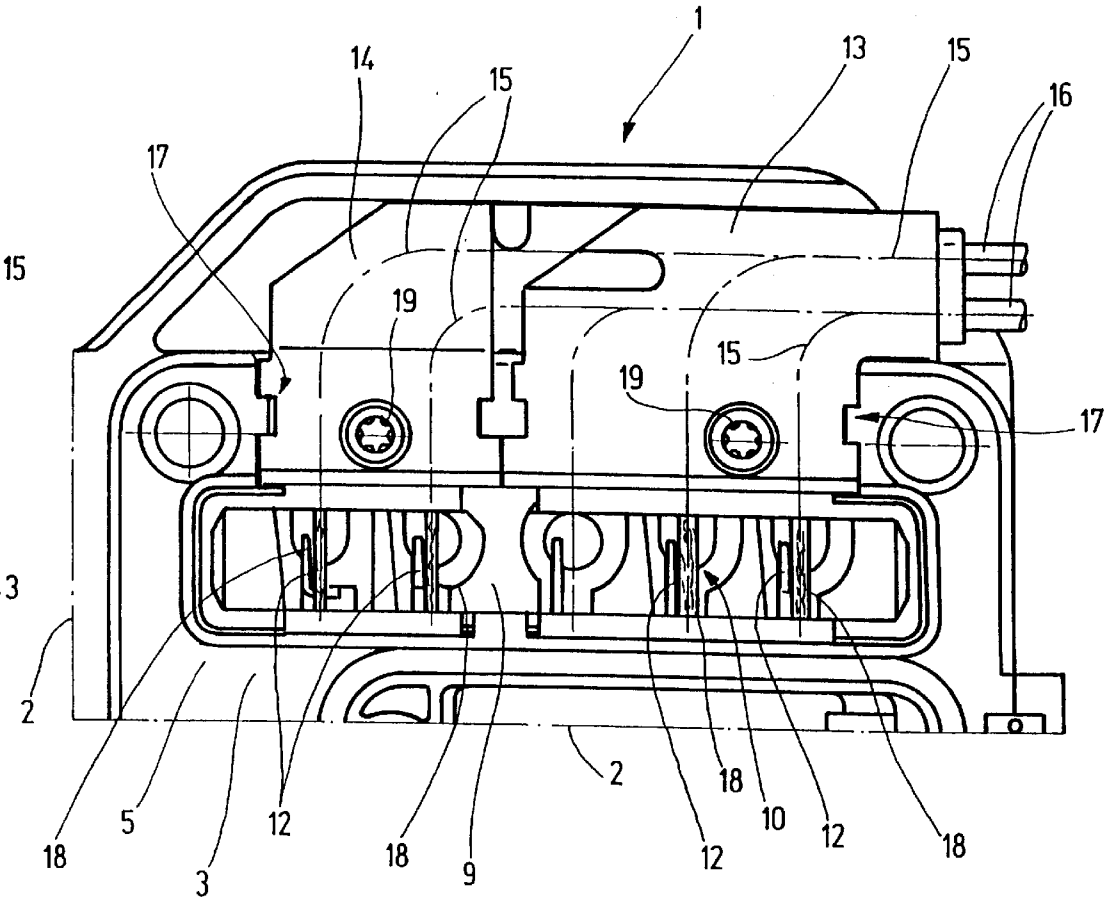
FIG. 1 shows a top view of an arc suppression housing, open.
Figure 2:
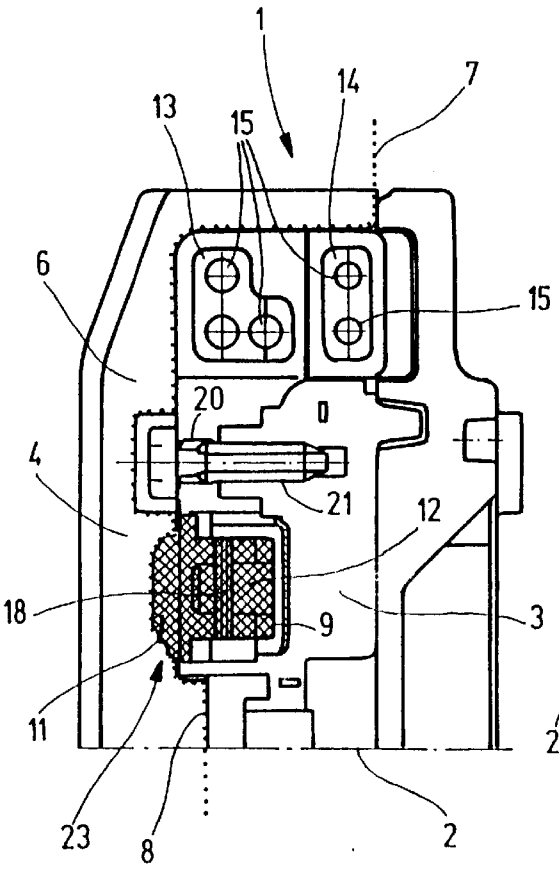
FIG. 2 shows a side view of the arc suppression housing according to FIG. 1, but closed.

FIG. 1 shows an arc suppression housing 1, only the portion that is relevant to the present invention being illustrated (break-off lines 2). Arc suppression housing 1 has a first housing part 3 and a second housing part 4 (FIG. 2). First housing part 3 forms a base part 5, to which second cover-like housing part 6 can be added, with joint 8, shown by a dotted line 7 in FIG. 2 being formed between the two housing parts 3 and 4. A connecting chamber 9, open to joint 8 and housing electric contacts 10, is formed in housing part 3. When put together, parts 3 and 4 enclose (as shown in FIG. 2) cover 6 of connecting chamber 9, which is filled with a sealing compound 11 to protect contacts 10. Contacts 10 are therefore embedded in sealing compound 11 and are protected against environmental effects.

Connecting chamber 9 of first housing part 3 has, for example, a basically rectangular shape (FIG. 1). It houses contact tabs 12, belonging to contacts 10 and fixedly positioned by suitable means, which lead to electric devices not shown in detail here, for example, a pedal sensor, an operating brake valve, or a pump controller of a motor vehicle. In order to be able to electrically connect this electric/electronic device, for example, to a cable harness of a motor vehicle, the electric conductors of the cable harness must be brought into contact with contact tabs 12. This is accomplished, according to FIGS. 1 and 2, using cable supports 13 and 14. Cable supports 13 and 14 are preferably designed as plastic parts having cable channels 15. Electric conductors 16 are placed into these cable channels 15, i.e., are held in the desired position. To accommodate cable supports 13 and 14 in housing part 3, guide means 17 are provided, which may be designed, for example, as groove/projection guides, so that cable supports 13 and 14 placed in housing part 3 assume a certain position with respect to connecting chamber 9. Electric conductors 16 have conductor strands 18, which assume a position opposite contact tabs 12 when cable supports 13 and 14 are inserted. In order to secure the position of the two cable supports 13 and 14, fastening screws 19 are provided, which extend through bores 20 of cable supports 13 and 14 and are screwed into threaded holes 21 of housing part 3. When the above-mentioned position of strands 18 opposite contact tabs 12 is achieved, strands 18 are contacted with the respective contact tabs 12 using a suitable electric contacting method such as soldering, welding or the like.

Figure 4:
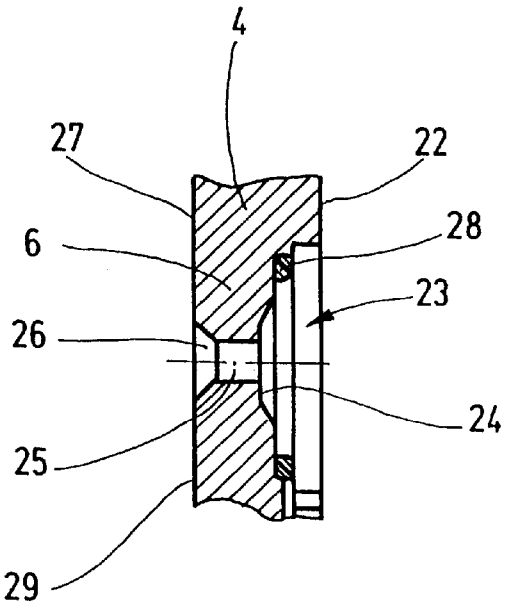
FIG. 4 shows a section along line IV—IV of FIG. 3.
Figure 3:
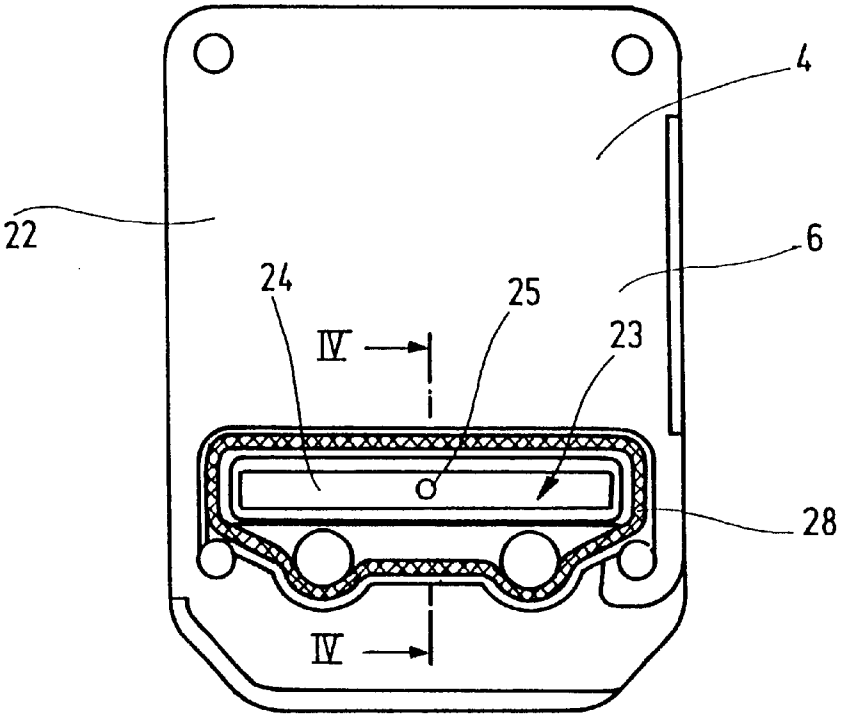
FIG. 3 shows a top view of one housing part of the arc suppression housing.

Housing part 4 forming cover 6 is illustrated in FIGS. 2, 3, and 4. It has a stepped depression 23 in its inside 22, basically matching the contour of connecting chamber 9. A sealing compound filling channel 25, extending in the form of a spray tool sealing funnel 26 to top 27 of cover 6, opens into bottom 24 of depression 23. A gasket 28 that is closed in itself as shown in FIG. 3 is arranged inside depression 23, this enclosed contour surrounding connecting chamber 9 when housing parts 3 and 4 are assembled. FIG. 3 shows that gasket 28 is designed so that it also encloses the heads of fastening screws 19.

FIG. 2 shows chat sealing compound 11 is in connecting chamber 9 and depression 23; this means that the electric connection of strands 18 with contact tabs 12 is embedded in sealing compound 11 and therefore protected against environmental effects.

The arc suppression housing according to the present invention is assembled as follows: first, electric conductors 16 are installed in cable supports 13, 14. Cable supports 13, 14 with conductors 16 are then placed into housing part 3 and secured using fastening screws 19. Then strands 18 are electrically connected to contact tabs 12. Cover 6 is installed on housing part 3, so that the position illustrated in FIG. 2 is obtained. Both housing parts 3, 4 are connected together using suitable connecting means, for example, screws (not illustrated). By joining both housing parts 3, 4, gasket 28 of housing part 4 is in sealing contact with housing part 3, with gasket 28 being designed so that it lets air through, but sealingly holds back liquid sealing compound.

Then an appropriately shaped injection tool is applied to spray tool sealing funnel 26 and sealing compound is injected into connecting chamber 9 and depression 23, so that the entire inner space, including the contact zone, is filled with sealing compound 11. Possible air or gas inclusions are avoided, as mentioned before, by the fact that gasket 28 lets these gas inclusions exit to the outside. On the other hand, sealing compound 11, which has not yet set or has not yet solidified, is held back by gasket 28. In particular, injection casting may take place using pressure, i.e., a pressure higher than atmospheric pressure. Thermoplastic adhesives or mixtures of materials containing such adhesives are used, in particular as sealing compound 11. The processing temperature depends on the thermoplastic adhesive and is preferably between 180° C. and 230° C. Filling under pressure allows the filling rate to be optimized and bubble formation to be avoided. The filling pressure of 5 to 50 bar, in particular, is preferably applied until the melt sets. After setting, the injection tool is removed from spray tool sealing funnel 26.

According to an embodiment, of the present invention, sealing compound filling channel 25, formed of the same material, i.e., by removing material, may extend to top 27 of housing part 4 and spray tool sealing funnel 26 extends therefrom to the outside beyond arc suppression housing 29 (FIG. 4). In order to remove this spray tool sealing funnel 26 extending to the outside after the injection has been completed, it is preferably attached to cover 6 via a break-off point.

The present invention is not limited to only one sealing compound filling channel 25 provided in cover 6, but a plurality of such channels can also be provided there, and it is furthermore possible that such channels are provided only in housing part 3 or both in housing part 3 and housing part 4.

The present invention allows manufacture in an assembly line without waiting times. No ovens or buffer zones are required as is necessary in the case of single-or two-component reaction resins, so that simple and inexpensive manufacturing and reliable arc suppression is ensured.

What is claimed is:

1. An arc suppression housing for an electric connection, comprising:

contacts; and at least two separate housing parts assembled together to form an enclosed shape, a sealing compound filling channel being formed in at least one of the at least two housing parts, wherein the at least one of the at least two housing parts is fillable with an unset sealing compound via the sealing compound filling channel, the contacts being arranged in the at least one of the at least two housing parts, at least one of the at least two housing parts including a peripheral gasket in contact with another one of the at least two housing parts, wherein the gasket defines a seal with respect to the unset sealing compound but is gas-permeable.

2. The housing according to claim 1, wherein the sealing compound filling channel opens into a spray tool sealing funnel situated on the housing.

3. The housing according to claim 2, wherein the spray tool sealing funnel extends over one housing part to an outside and is attached via a break-off point.

4. The housing according to claim 1, wherein the gasket is vulcanized to at least one of the at least two housing parts.

5. The housing according to claim 2, wherein the spray tool sealing funnel is formed in a wall of one of the at least two housing parts.

* * * * *